US009193083B2

(12) United States Patent
Chen

(10) Patent No.: US 9,193,083 B2
(45) Date of Patent: Nov. 24, 2015

(54) HANDLING MECHANISM AND PUNCHING MACHINE USING THE SAME

(75) Inventor: Wen-Sheng Chen, Shenzhen (CN)

(73) Assignees: HONG FU JIN PRECISION INDUSTRY (ShenZhen) CO., LTD., Shenzhen (CN); HON HAI PRECISION INDUSTRY CO., LTD., New Taipei (TW)

( * ) Notice: Subject to any disclaimer, the term of this patent is extended or adjusted under 35 U.S.C. 154(b) by 662 days.

(21) Appl. No.: 13/448,567

(22) Filed: Apr. 17, 2012

(65) Prior Publication Data

US 2013/0133493 A1 May 30, 2013

(30) Foreign Application Priority Data

Nov. 25, 2011 (CN) ..... 2011 1 0380740

(51) Int. Cl.
*B26D 7/06* (2006.01)
*B21D 28/00* (2006.01)
*B21D 43/10* (2006.01)

(52) U.S. Cl.
CPC *B26D 7/06* (2013.01); *B21D 28/00* (2013.01); *B21D 43/105* (2013.01); *Y10T 83/654* (2015.04)

(58) Field of Classification Search
CPC ..... B26D 5/16; B26D 7/01; B26D 7/02; B26D 7/06; B26D 7/26; B65G 65/00; Y10T 83/654; Y10T 83/8785; Y10T 83/8857; Y10T 83/8841; Y10T 83/8853; Y10T 83/8878
USPC ..... 83/409, 588, 638, 627, 635, 821; 414/225.01, 749.1, 749.6; 72/419, 72/452.1, 452.9, 452.8; 198/465.8, 465.9, 198/750.1
See application file for complete search history.

(56) References Cited

U.S. PATENT DOCUMENTS

| | | | | |
|---|---|---|---|---|
| 4,003,476 | A * | 1/1977 | Laskey | 198/468.6 |
| 5,101,705 | A * | 4/1992 | Matsuoka | 83/588 |
| 6,378,353 | B1 * | 4/2002 | Wunderlich | 72/389.4 |
| 6,997,029 | B2 * | 2/2006 | Chun et al. | 72/452.9 |
| 7,043,956 | B2 * | 5/2006 | Higuchi et al. | 72/452.9 |
| 8,132,662 | B1 * | 3/2012 | Chen | 198/468.9 |

FOREIGN PATENT DOCUMENTS

| | | |
|---|---|---|
| CN | 202038718 U | 11/2011 |
| JP | 11-179637 A | 7/1999 |
| JP | 2001-510130 | 7/2001 |
| TW | 298577 | 2/1997 |
| TW | I301118 | 9/2008 |

* cited by examiner

*Primary Examiner* — Phong Nguyen
(74) *Attorney, Agent, or Firm* — Novak Druce Connolly Bove + Quigg LLP

(57) ABSTRACT

A handling mechanism for handling workpieces includes a first sliding assembly, a second sliding assembly, a driving assembly, a loading assembly and a clamping assembly. The driving assembly is connected to the first sliding assembly and the second sliding assembly. The loading assembly is slidably clamped between the first sliding assembly and the second sliding assembly. The clamping assembly is fixed to the loading assembly for clamping and placing workpieces one by one. The first sliding assembly and the second sliding assembly are driven by the driving assembly to slide along a same direction or in two opposing directions, to enable the loading assembly to slide with the first sliding assembly or to slide along a direction perpendicular to the sliding direction of the first sliding assembly. A punching machine using the handling mechanism is also disclosed, in which workpieces are placed by clamping assembly on lower mold for punching.

18 Claims, 6 Drawing Sheets

HANDLING MECHANISM AND PUNCHING MACHINE USING THE SAME

CROSS-REFERENCE TO RELATED APPLICATIONS

This application is related to three co-pending U.S. patent applications, which are: applications Ser. Nos.13/438,182, 13/443,202 and 13/458,430. The co-pending applications have the same assignee as the present application. The disclosure of the above identified applications are incorporated herein by reference.

BACKGROUND

1. Technical Field

The present disclosure relates to handling mechanisms, and more particularly, to a handling mechanism used in a punching machine.

2. Description of Related Art

A punching machine employs a handling mechanism to convey workpieces. One handling mechanism includes a mounting enclosure, a driving assembly mounted on the mounting enclosure, and a sliding member driven by the driving assembly. However, the sliding member is capable of sliding relative to the mounting enclosure along one direction only. In order to convey workpieces along two perpendicular directions, a robot can be employed to work with the punching machine. However, the robot has a complicated structure and the cost of the robot is relatively high.

Therefore, there is room for improvement in the art.

BRIEF DESCRIPTION OF THE DRAWINGS

The components in the drawings are not necessarily drawn to scale, the emphasis instead placed upon clearly illustrating the principles of the present disclosure. Moreover, in the drawings, like reference numerals designate corresponding parts throughout the several views.

DETAILED DESCRIPTION

Figure 1:
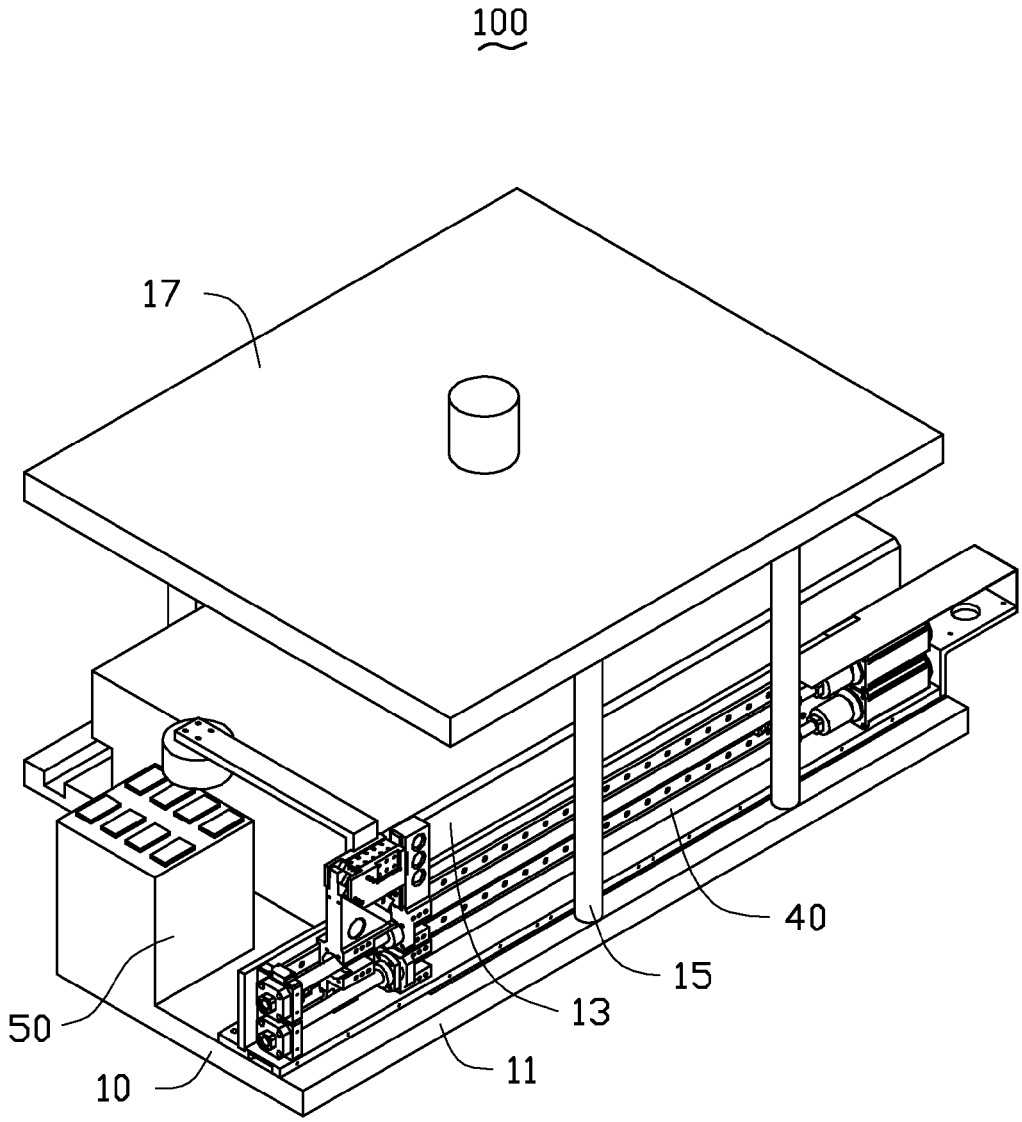
FIG. 1 is an isometric view of an embodiment of a punching machine.
Figure 2:
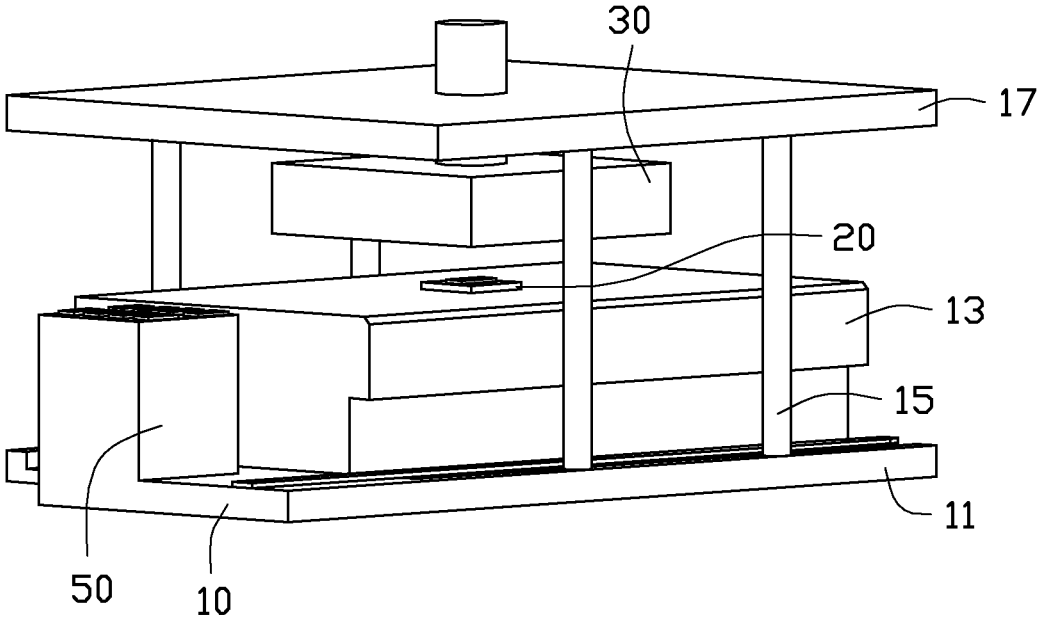
FIG. 2 is similar to FIG. 1, but viewed from another aspect without a handling mechanism.

Referring to FIGS. 1 and 2, an embodiment of a punching machine 100 includes a base seat 10, a lower mold 20, an upper mold 30, a driver (not shown), a handling mechanism 40 and a workpiece feeding table 50. The lower mold 20 and the handling mechanism 40 are fixed on the base seat 10 adjacent to each other. The handling mechanism 40 clamps a workpiece from the workpiece feeding table 50 and positions the workpiece on the lower mold 20. The upper mold 30 is movably mounted over the lower mold 20, and connects with the driver. The upper mold 30 is driven by the driver, and capable of pressing and punching the workpiece on the lower mold 20.

The base seat 10 includes a bottom plate 11, a support table 13, a plurality of support posts 15 and an upper plate 17. The bottom plate 11 is substantially a rectangular plate. The support table 13 is mounted on a middle portion of the bottom plate 11. The plurality of support posts 15 is located at two sides of the bottom plate 11, a bottom end of each support post 15 is fixed to the bottom plate 11. The upper plate 17 is a substantially rectangular plate, and is fixed on a top end of the support posts 15. The upper plate 17 is parallel to the bottom plate 11.

The lower mold 20 is mounted on a middle portion of the support table 13. The upper mold 30 is movably mounted on the upper plate 17 and connects with the driver. The upper mold 30 is capable of moving toward the support table 13.

Figure 3:
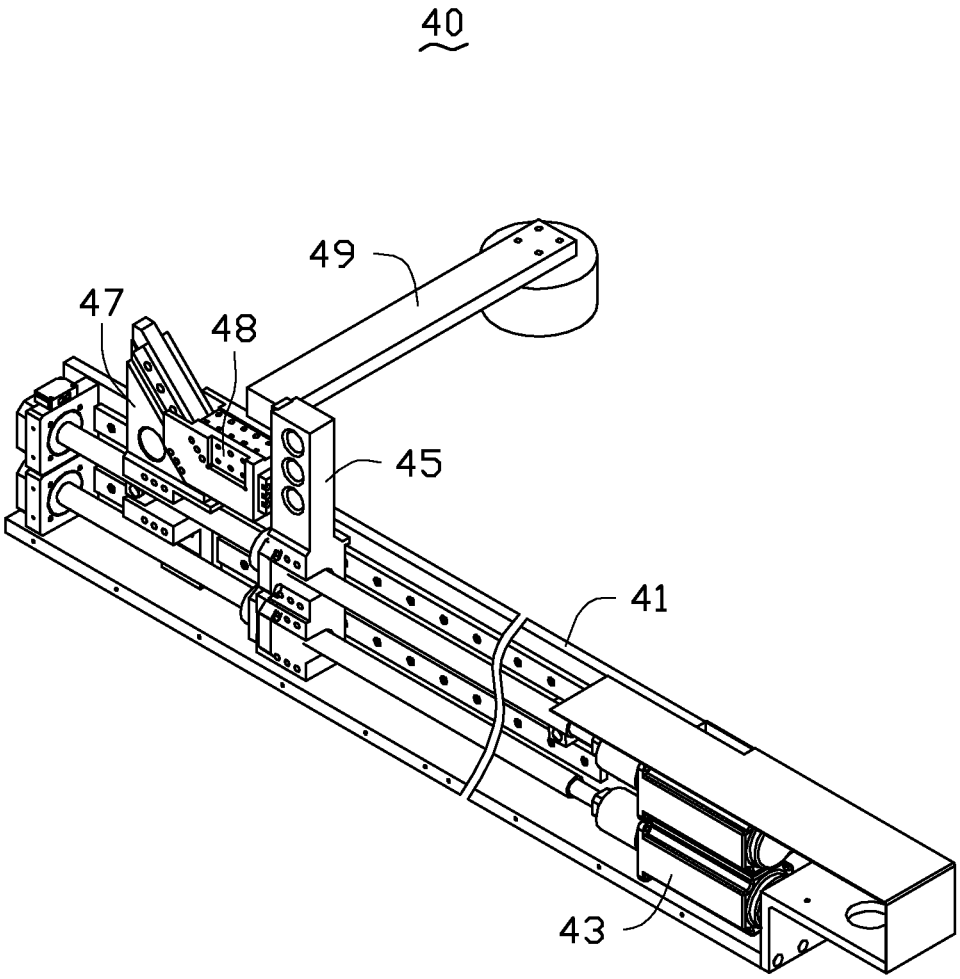
FIG. 3 is an isometric view of a handling mechanism of the punching machine of FIG. 2.
Figure 4:
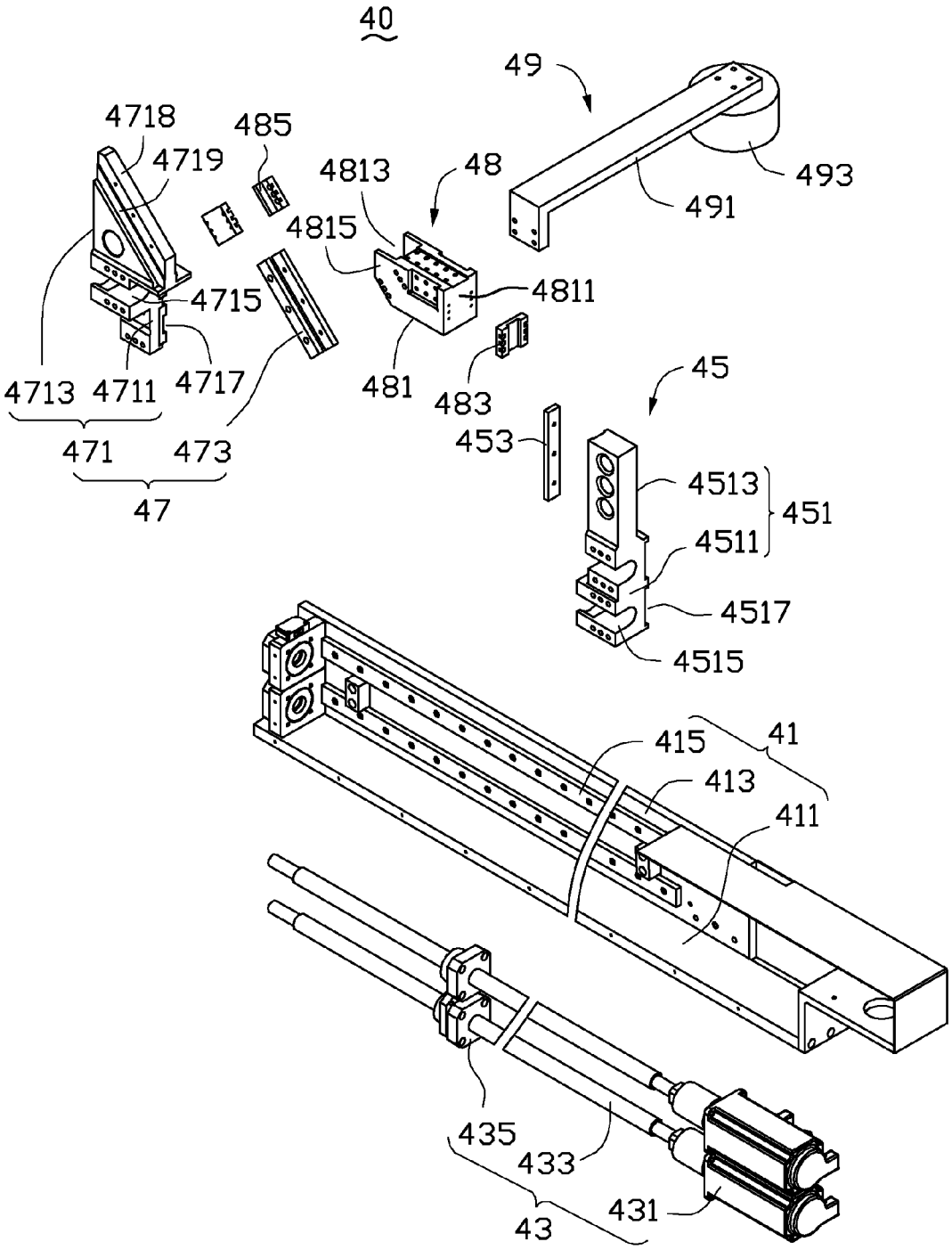
FIG. 4 is an exploded, isometric view of the handling mechanism of FIG. 3, the handling mechanism including a mounting enclosure, a driving assembly, a first sliding assembly, a second sliding assembly, a loading assembly and a clamping assembly.
Figure 5:
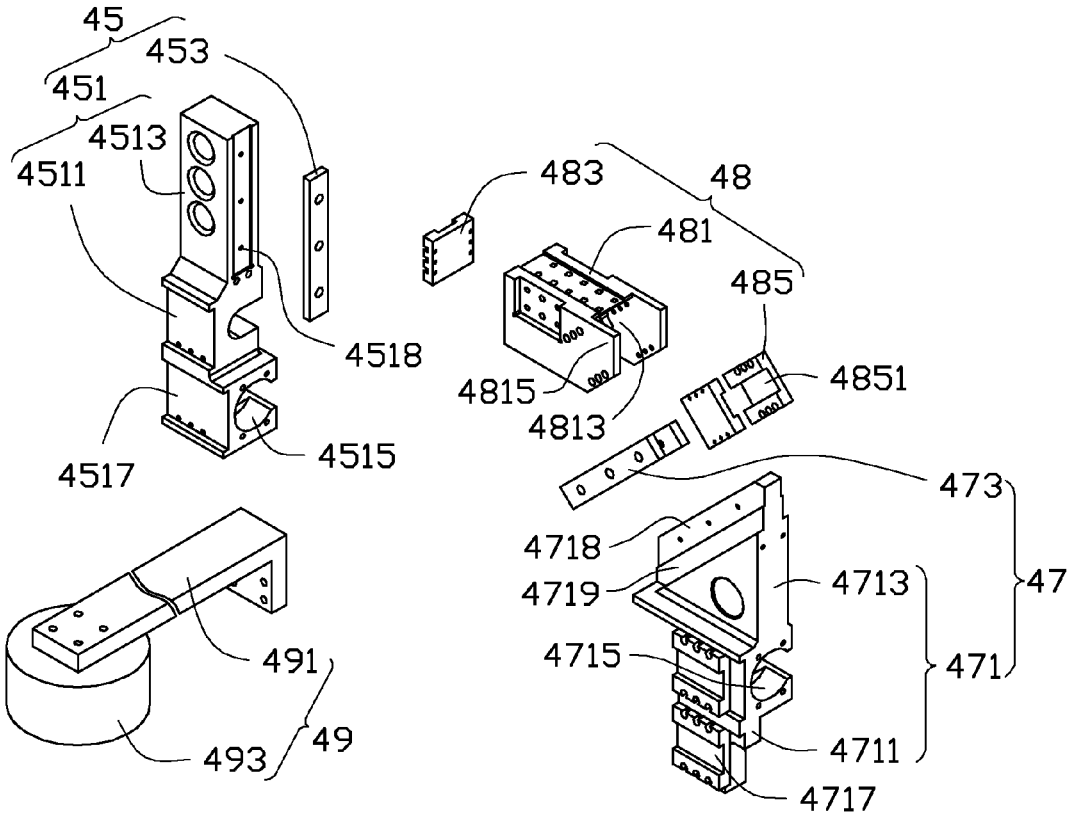
FIG. 5 is an exploded, isometric view of a first sliding assembly, a second sliding assembly, a loading assembly and a clamping assembly of the handling mechanism of FIG. 3.
Figure 6:
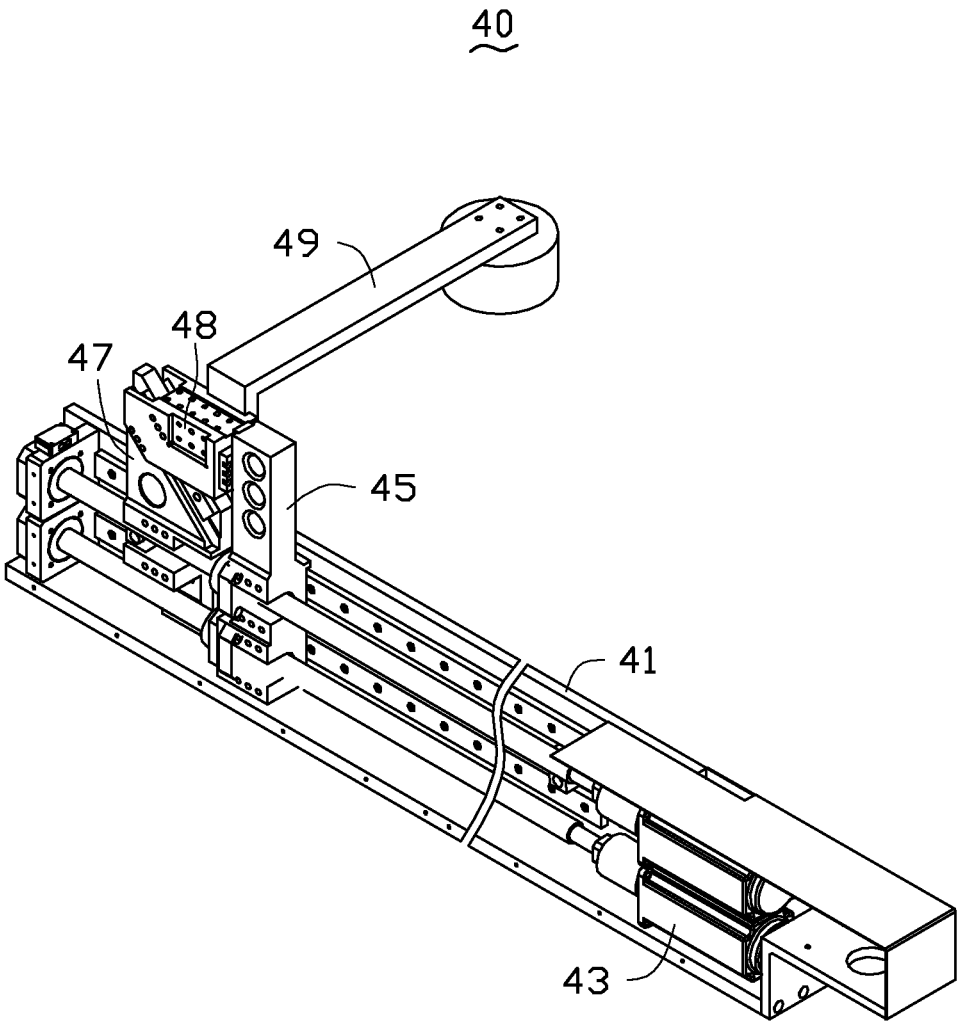
FIG. 6 is an isometric view of the handling mechanism of FIG. 3 while operating in another state.

Also referring to FIGS. 3 through 5, the handling mechanism 40 is substantially rectangular and mounted on the bottom plate 11. The handling mechanism 40 includes a mounting enclosure 41, a driving assembly 43, a first sliding assembly 45, a second sliding assembly 47, a loading assembly 48 and a clamping assembly 49. The driving assembly 43 is mounted on the mounting enclosure 41; the first sliding assembly 45 and the second sliding assembly 47 are slidably mounted on the mounting enclosure 41 adjacent to each other and are driven by the driving assembly 43. The loading assembly 48 is slidably clamped between the first sliding assembly 45 and the second sliding assembly 47. The loading assembly 48 is capable of moving perpendicular to the moving directions of the first sliding assembly 45 and the second sliding assembly 47. The clamping assembly 49 is fixed to the loading assembly 48 to clamp, and place the workpieces.

The mounting enclosure 41 is a bar of material and is fixed to the bottom plate 11. The mounting enclosure 41 includes a bottom plate 411, a side panel 413 bent from a side of the bottom plate 411 and a pair of guiding rails 415 formed on the side panel 413. The pair of guiding rails 415 extends along the longitudinal direction of the side panel 413.

The driving assembly 43 includes a pair of drivers 431, a pair of lead screws 433 and a pair of nuts 435. The pair of drivers 431 is secured on an end of the mounting enclosure 41 and adjacent to each other. The pair of lead screws 433 is mounted on the bottom plate 411 along the longitudinal direction of the mounting enclosure 41. The pair of lead screws 433 is substantially parallel to and spaced from the pair of guiding rails 415. An end of each lead screw 433 is connected to one driver 431. The nuts 435 are sleeved on the lead screws 433, respectively, and are capable of being moved along the longitudinal direction of the pair of lead screws 433 when the lead screws 433 rotate.

The first sliding assembly 45 slidably engages with the pair of guiding rails 415 and is fixed to one nut 435. The first sliding assembly 45 includes a first sliding block 451 and a first guiding rail 453 connected to a side of the first sliding block 451. The first sliding block 451 includes a base 4511 and a mounting portion 4513 connected to an end of the base 4511. The base 4511 defines a pair of rotation grooves 4515 and a pair of sliding grooves 4517 on opposite sides of the base 4511. The mounting portion 4513 defines a mounting surface 4518 at a side thereof. The first guiding rail 453 is mounted on the mounting surface 4518.

The second sliding assembly 47 slidably engages with the pair of guiding rails 415 and is fixed to another nut 435. The second sliding assembly 47 includes a second sliding block 471 and a pair of second guiding rails 473 fixed to the second sliding block 471. The second sliding block 471 includes a base 4711 and a wedge portion 4713 connected to an end of the base 4711. The base 4711 defines a rotation groove 4715 at a side thereof corresponding to one lead screw 433. The base 4711 defines a pair of sliding grooves 4717 at a side thereof opposite to the rotation groove 4715. The wedge portion 4713 includes a wedge wall 4718 and defines a pair of mounting grooves 4719 at opposite sides of the wedge wall 4718. A top surface of the wedge wall 4718 and the rotation groove 4715 define an inclined angle. The second guiding rails 473 are fixedly received in the mounting grooves 4719.

The loading assembly 48 is slidably clamped between the first sliding assembly 45 and the second sliding assembly 47. The loading assembly 48 includes a bearing seat 481, a first moving member 483 and a pair of second moving members 485. The first moving member 483 is located at a side of the bearing seat 481, and the pair of second moving members 485 is located at a side of the bearing seat 481 away from the first moving member 483. The bearing seat 481 has a reverse trapezium shape. The bearing seat 481 defines a fixing surface 4811 at side thereof, and a receiving groove 4813 at a side opposite to the fixing surface 4811. The bearing seat 481 includes a pair of mounting portions 4815 at opposite sides of the receiving groove 4813. Each of the pair of mounting portions 4815 defines a moving surface (not labeled) away from the fixing surface 4811. The moving surface and the fixing surface 4811 define an inclined angle. The first moving member 483 is fixed to the fixing surface 4811, and slidably engages with the first guiding rail 453. Each of the second moving members 485 is received in the receiving groove 4813 and fixed to one mounting portion 4815. The longitudinal direction of each second moving member 485 is parallel to the extending direction of the moving surface. The second moving member 485 defines a groove 4851 at a side thereof corresponding to the second guiding rail 473.

The clamping assembly 49 is fixed to a side of the loading assembly 48. The clamping assembly 49 includes a support plate 491 and a clamping member 493 connected to an end of the support plate 491. The support plate 491 is in a "L" shape, and fixed to a side of the bearing seat 481. The clamping member 493 is fixed to an end portion of the support plate 491 away from the bearing seat 481 to clamp, and place (or present) a workpiece. In the embodiment, the clamping member 493 is circular and relies on a vacuum created in its sucker for holding the workpeice.

The workpiece feeding table 50 is located at a side of the bottom plate 11 for receiving the workpieces presented to it.

Referring to FIGS. 1 through 6, in assembly, the first sliding block 451 of the first sliding assembly 45 and the second sliding block 471 of the second sliding assembly 47 each slidably engages with one guiding rail 415 of the mounting enclosure 41. The loading assembly 48 is slidably clamped between the first sliding assembly 45 and the second sliding assembly 47. The pair of drivers 431 is mounted on the mounting enclosure 41. The lead screws 433 are fixed to the drivers 431, and each lead screw 433 extends through the rotation grooves 4515 of first sliding assembly 45. A lead screw 433 extends through the rotation groove 4715 of the second sliding assembly 471. The nuts 435 are engaged with the lead screws 433, one set of nut and screw are fixed to the first sliding block 451 and the second set of nut and screw are fixed to the second sliding block 471. The clamping assembly 49 is mounted on the bearing seat 481, and the mounting enclosure 41 is fixed to the bottom plate 11. The lower mold 20, the upper mold 30, the workpiece feeding table 50 and the driver are all mounted on the bottom plate 11 to complete the assembling of the punching machine 100.

In use, a plurality of workpieces for punching are settled and placed on the workpiece feeding table 50. The pair of drivers 431 drives the pair of lead screws 433 to rotate, then the pair of nuts 435 drives the first sliding assembly 45 and the second sliding assembly 47 to slide along the pair of guiding rails 415, and thus the loading assembly 48 drives the clamping assembly 49 to move along the longitudinal direction of the mounting enclosure 41. When the clamping assembly 49 approaches the workpiece feeding table 50, it clamps a workpiece. Then the pair of drivers 431 drives the pair of lead screws 433 to rotate in two opposite directions, and the pair of nuts 435 drives the first sliding assembly 45 and the second sliding assembly 47 to move toward each other. The loading assembly 48 is driven by the first sliding assembly 45 and the second sliding assembly 47, and moves upwards along a direction perpendicular to the bottom plate 11. When the pair of lead screws 433 rotates along the same direction again, the pair of nuts 435 drives the loading assembly 48 to move toward the lower mold 20. When the clamping assembly 49 approaches the lower mold 20, the pair of lead screws 433 rotate again in two opposite directions, the pair of nuts 435 drives the first sliding assembly 45 and the second sliding assembly 47 to move away from each other. Such that the loading assembly 48 moves downward along a direction perpendicular to the bottom plate 11. Then the clamping member 493 releases the workpiece and places it on the lower mold 20 to be punched. The loading assembly 48 returns to the workpiece feeding table 50. The upper mold 30 punches the workpiece on the lower mold 20. The punching machine 100 works cyclically in this manner.

The pair of drivers 431 drive the pair of lead screws 433 to rotate along a same direction with a same speed, the loading assembly 48 is capable of moving along the longitudinal direction of the mounting enclosure 41 to hand a workpiece horizontally. When the pair of drivers 431 drives the pair of second lead screws 433 to rotate in two opposite directions, the loading assembly 48 is capable of moving along a direction perpendicular to the longitudinal direction of the mounting enclosure 41 to handle a workpiece vertically. In adopting such components as described, the handling mechanism 40 is simpler and the cost is decreased. The loading assembly 48 slidably engages with the first sliding assembly 45 via the first guiding rail 453 and slidably engages with the second sliding assembly 47 via the pair of second guiding rails 473, and any deformation of the support plate 491 is reduced and the positioning accuracy of the handling mechanism 40 is improved. Moreover, the handing mechanism 40 is very narrow, and thus is suitable to be mounted in a small or tight space.

When the first sliding assembly 45 includes a sliding rail which is integral with the mounting surface 4518, the bearing seat 481 defines a pair of guiding grooves thereon corresponding to the sliding rail and the pair of wedge walls 4718, then the first guiding rails 453, the second guiding rails 473, the first moving member 483, the second moving member 485 may be omitted.

While various embodiments have been described and illustrated, the disclosure is not to be construed as being limited thereto. Various modifications can be made to the embodiments by those skilled in the art without departing from the true spirit and scope of the disclosure as defined by the appended claims.

What is claimed is:

1. A handling mechanism, comprising:

a first sliding assembly;

a second sliding assembly;

a mounting enclosure;

a driving assembly mounted on the mounting enclosure and connected to the first sliding assembly and the second sliding assembly, the driving assembly comprising:

a pair of drivers secured on the mounting enclosure, a pair of lead screws rotatably mounted on the mounting enclosure and fixed to the pair of drivers respectively, and a pair of nuts, the first sliding assembly and the second sliding assembly connected to the pair of lead screws respectively and capable of sliding along the longitudinal direction of the pair of lead screws;

a loading assembly slidably clamped between the first sliding assembly and the second sliding assembly, wherein the first sliding assembly and the second sliding assembly are driven by the driving assembly to slide along a same direction, to enable the loading assembly to slide alongside with the first sliding assembly; and the first sliding assembly and the second sliding assembly are driven by the driving assembly to slide along two opposite directions respectively, to enable the loading assembly to slide along a direction perpendicular to the sliding direction of the first sliding assembly; and a clamping assembly fixed to the loading assembly for clamping one or more workpieces.

2. The handling mechanism of claim 1, wherein the driving assembly further comprises the pair of nuts sleeved on the pair of lead screws respectively, the pair of nuts are fixed to the first sliding assembly and the second sliding assembly respectively and capable of moving along the longitudinal direction of the pair of lead screws.

3. The handling mechanism of claim 2, wherein the first sliding assembly comprises a first sliding block and a first guiding rail connected to a side of the first sliding block, the first sliding block comprises a base and a mounting portion connected to an end of the base, the base is fixed to one of the pair of nuts and defines a pair of rotation grooves, the first sliding block is sleeved on the pair of the lead screws via the pair of rotation grooves.

4. The handling mechanism of claim 3, wherein the second sliding assembly comprises a second sliding block and a pair of second guiding rails fixed to the second sliding block, the second sliding block comprises a base and a wedge portion connected to an end of the base, the base is fixed to another one of the pair of nuts and defines a rotation groove at a side thereof, the second sliding block is sleeved on one of the pair of the lead screws via the rotation groove.

5. The handling mechanism of claim 4, wherein the wedge portion comprises a wedge wall and defines a pair of mounting grooves at opposite sides of the wedge wall, a top surface of the wedge wall and the rotation groove define an inclined angle, the pair of second guiding rails is fixedly received in the pair of mounting grooves respectively.

6. The handling mechanism of claim 1, wherein the loading assembly comprises a bearing seat, a first moving member and a pair of second moving members, the first moving member is located at a side of the bearing seat, the pair of second moving members is located at a side of the bearing seat away from the first moving member, the first sliding assembly comprises a first guiding rail, the second sliding assembly comprises a pair of second guiding rails, the first moving member engages with the first guiding rail, the pair of second moving members engages with the pair of second guiding rails respectively.

7. The handling mechanism of claim 6, wherein the bearing seat has a reverse trapezium shape, the bearing seat defines a fixing surface at side thereof and a receiving groove at a side opposite to the fixing surface, the bearing seat comprises a pair of mounting portions at opposite sides of the receiving groove, the first moving member is fixed to the fixing surface, the pair of second moving members are received in the receiving groove and fixed to the pair of mounting portions respectively.

8. The handling mechanism of claim 7, wherein each one of the pair of mounting portions defines a moving surface away from the fixing surface, the moving surface and the fixing surface define an inclined angle, the longitudinal direction of each one of the pair of second moving members is parallel to the extending direction of the moving surface.

9. The handling mechanism of claim 8, wherein each one of the pair of second moving members defines a groove thereof, the second sliding assembly comprises a second sliding block, the second sliding block comprises a wedge portion, the wedge portion defines a pair of mounting grooves on a top portion thereof, the pair of second guiding rails is fixedly received in the pair of mounting grooves respectively, the pair of second moving members slidably engage with the pair of second guiding rails respectively via the pair of grooves.

10. A punching machine, comprising:

a base seat;

a lower mold mounted on the base seat;

an upper mold mounted on the base seat and capable of punching one or more workpieces on the lower mold;

a workpiece feeding table; and a handling mechanism mounted on the base seat and configured adjacent to the lower mold, comprising:

a first sliding assembly;

a second sliding assembly;

a mounting enclosure;

a driving assembly mounted on the mounting enclosure and connected to the first sliding assembly and the second sliding assembly, the driving assembly comprising:

a pair of drivers secured on the mounting enclosure, a pair of lead screws rotatably mounted on the mounting enclosure and fixed to the pair of drivers respectively, and a pair of nuts, the first sliding assembly and the second sliding assembly connected to the pair of lead screws respectively and capable of sliding along the longitudinal direction of the pair of lead screws;

a loading assembly slidably clamped between the first sliding assembly and the second sliding assembly, wherein the first sliding assembly and the second sliding assembly are driven by the driving assembly to slide along a same direction, to enable the loading assembly to slide alongside with the first sliding assembly; and the first sliding assembly and the second sliding assembly are driven by the driving assembly to slide along two opposite directions respectively, to enable the loading assembly to slide along a direction perpendicular to the sliding direction of the first sliding assembly; and a clamping assembly fixed to the loading assembly for clamping the workpieces.

11. The punching machine of claim 10, wherein the driving assembly further comprises the pair of nuts sleeved on the pair of lead screws respectively, the pair of nuts are fixed to the first sliding assembly and the second sliding assembly respectively and capable of moving along the longitudinal direction of the pair of lead screws.

12. The punching machine of claim 11, wherein the first sliding assembly comprises a first sliding block and a first guiding rail connected to a side of the first sliding block, the first sliding block comprises a base and a mounting portion connected to an end of the base, the base is fixed to one of the pair of nuts and defines a pair of rotation grooves, the first sliding block is sleeved on the pair of the lead screws via the pair of rotation grooves.

13. The punching machine of claim 12, wherein the second sliding assembly comprises a second sliding block and a pair of second guiding rails fixed to the second sliding block, the second sliding block comprises a base and a wedge portion connected to an end of the base, the base is fixed to another one of the pair of nuts and defines a rotation groove at a side thereof, the second sliding block is sleeved on one of the pair of the lead screws via the rotation groove.

14. The punching machine of claim 13, wherein the wedge portion comprises a wedge wall and defines a pair of mounting grooves at opposite sides of the wedge wall, a top surface of the wedge wall and the rotation groove define an inclined angle, the pair of second guiding rails is fixedly received in the pair of mounting grooves respectively.

15. The punching machine of claim 10, wherein the loading assembly comprises a bearing seat, a first moving member and a pair of second moving members, the first moving member is located at a side of the bearing seat, the pair of second moving members is located at a side of the bearing seat away from the first moving member, the first sliding assembly comprise a first guiding rail, the second sliding assembly comprises a pair of second guiding rails, the first moving member engages with the first guiding rail, the pair of second moving members engages with the pair of second guiding rails respectively.

16. The punching machine of claim 15, wherein the bearing seat has a reverse trapezium shape, the bearing seat defines a fixing surface at side thereof and a receiving groove at a side opposite to the fixing surface, the bearing seat comprises a pair of mounting portions at opposite sides of the receiving groove, the first moving member is fixed to the fixing surface, the pair of second moving members are received in the receiving groove and fixed to the pair of mounting portions respectively.

17. The punching machine of claim 16, wherein each one of the pair of mounting portions defines a moving surface away from the fixing surface, the moving surface and the fixing surface define an inclined angle, the longitudinal direction of each one of the pair of second moving members is parallel to the extending direction of the moving surface.

18. The punching machine of claim 17, wherein each one of the pair of second moving members defines a groove thereof, the second sliding assembly comprises a second sliding block, the second sliding block comprises a wedge portion, the wedge portion defines a pair of mounting grooves on a top portion thereof, the pair of second guiding rails is fixedly received in the pair of mounting grooves respectively, the pair of second moving members slidably engage with the pair of second guiding rails respectively via the pair of grooves.

* * * * *